US007112264B2

(12) United States Patent
Tsuzuki et al.

(10) Patent No.: US 7,112,264 B2
(45) Date of Patent: Sep. 26, 2006

(54) PLATING APPARATUS AND METHOD

(75) Inventors: Hidetoshi Tsuzuki, Kanagawa (JP); Noboru Toyama, Osaka (JP); Yasuyoshi Takai, Nara (JP); Ryo Hayashi, Nara (JP); Yuichi Sonoda, Nara (JP); Masumitsu Iwata, Kyoto (JP); Yusuke Miyamoto, Kyoto (JP)

(73) Assignee: Canon Kabushiki Kaisha, Tokyo (JP)

( * ) Notice: Subject to any disclaimer, the term of this patent is extended or adjusted under 35 U.S.C. 154(b) by 257 days.

(21) Appl. No.: 10/606,956

(22) Filed: Jun. 27, 2003

(65) Prior Publication Data

US 2004/0011655 A1 Jan. 22, 2004

(30) Foreign Application Priority Data

Jul. 3, 2002 (JP) ..... 2002-195172

(51) Int. Cl.
*C25D 5/02* (2006.01)
*C25D 7/06* (2006.01)
*C25D 17/00* (2006.01)

(52) U.S. Cl. ..... 204/206; 204/198; 204/211; 205/130; 205/138

(58) Field of Classification Search ..... 205/129–130, 205/135–138, 96, 134; 204/198, 199, 202, 204/205, 206, 211
See application file for complete search history.

(56) References Cited

U.S. PATENT DOCUMENTS 3,483,098 A * 12/1969 Kramer ..... 205/130
4,124,454 A * 11/1978 Shang ..... 205/89
4,652,346 A * 3/1987 Polan ..... 205/111
5,804,466 A 9/1998 Arao et al. ..... 438/95
6,068,755 A 5/2000 Matsuda et al. ..... 205/333
6,077,411 A * 6/2000 Nakamura ..... 205/138
6,133,061 A 10/2000 Sonoda ..... 438/69
6,346,184 B1 2/2002 Sano et al. ..... 205/199
6,576,112 B1 6/2003 Sonoda et al. ..... 205/155

(Continued)

FOREIGN PATENT DOCUMENTS

JP 10-60686 3/1998

(Continued)

OTHER PUBLICATIONS

Sannomiya, et al.; "a-SiC/a-Si/a-SiGe Multi-Bandgap Stacked Solar Cells With Bandgap Profiling"; Int'l PVSEC-5, 387-390 (1990).

*Primary Examiner*—Nam Nguyen
*Assistant Examiner*—Luan V. Van
(74) *Attorney, Agent, or Firm*—Fitzpatrick, Cella, Harper & Scinto

(57) ABSTRACT

A plating apparatus includes a plating vessel for holding a plating bath containing at least metal ions, a conveying device for conveying a long conductive substrate and immersing the long conductive substrate in the plating bath, a facing electrode disposed in the plating bath so as to face one surface of the conductive substrate, a voltage application device for performing plating on the one surface of the conductive substrate by applying a voltage between the conductive substrate and the facing electrode, and a film-deposition suppression device fixedly disposed in the plating vessel so that at least a portion of the film-deposition suppression means is close to shorter-direction edges of the conductive substrate. At least a portion of the film-deposition suppression device close to the shorter-direction edges of the conductive substrate is conductive. By holding the conductive portion of the film-deposition suppression device and the conductive substrate at substantially the same potential, film deposition on the other surface of the conductive substrate is suppressed.

7 Claims, 3 Drawing Sheets

U.S. PATENT DOCUMENTS

| | | | | |
|---|---|---|---|---|
| 2002/0063065 | A1 | 5/2002 | Sonoda et al. | 205/333 |

FOREIGN PATENT DOCUMENTS

| | | |
|---|---|---|
| JP | 10-140373 | 5/1998 |
| JP | 10-195693 | 7/1998 |
| JP | 10-259496 | 9/1998 |
| JP | 11-286799 | 10/1999 |
| JP | 2002-155396 | 5/2002 |
| JP | 2002-167695 | 6/2002 |

* cited by examiner

PLATING APPARATUS AND METHOD

BACKGROUND OF THE INVENTION

1. Field of the Invention

The present invention relates to a plating apparatus and method for performing plating on a long conductive substrate.

2. Description of the Related Art

Plating apparatuses and methods for continuously performing plating on a long conductive substrate are used in various technical fields. For example, photovoltaic devices, such as solar cells or the like, are configured by laminating a reflective layer, a transparent layer (for example, a zinc-oxide layer), a semiconductor layer and a transparent conductive layer on a supporting member. Plating apparatuses and methods for a long substrate are sometimes used for manufacturing such devices.

The configuration of a photovoltaic device, and a method for manufacturing the same, and the like will now be described.

Hydrogenated amorphous silicon, hydrogenated amorphous silicon germanium, hydrogenated silicon carbide, microcrystalline silicon, polycrystalline silicon or the like is used for the semiconductor layer.

The reflective layer has the function of improving absorption efficiency for long-wavelength light, and desirably has a reflection property effective at wavelengths near the band gap of a semiconductor material where absorption is small, i.e., wavelengths of 800–1,200 nm. A metal layer made of gold, silver, copper, aluminum or the like sufficiently satisfies this condition.

The transparent layer (for example, a zinc-oxide layer) is disposed between the reflective layer and the semiconductor layer for confining light and improving a short-current density Jsc by effectively utilizing the reflective layer. In order to prevent degradation of characteristics due to a shunt path, a layer made of a conductive transparent material, i.e., a transparent conductive layer, is provided between the reflective layer and the semiconductor layer. Usually, these layers are deposited according to vacuum deposition or sputtering, and improvement in terms of a short-current density equal or more than 1 $mA/cm^2$ is obtained.

For example, in "A light confinement effect in an a-SiGe solar cell on a 29 p-MF-22 stainless steel substrate", Extended Abstracts (the $51^{st}$ Autumn Meeting, 1990) of the Japan Society of Applied Physics, p. 747, or in "P-IA-15a-SiC/a-Si/a-SiGe Multi-Band Gap Stacked Solar Cells with Band Gap Profiling", Sannomiya et al., Technical Digest of the International PVSEC-5, Kyoto, Japan, p. 381, 1990, studies have been done on the reflectivity and the texture structure of a reflective layer made of silver atoms. In these examples, effective projections and recesses are formed by using two silver layers deposited at different substrate temperatures as the reflective layer, and an increase in short current due to a light confining effect is achieved by combination with a zinc oxide layer formed thereon.

The transparent layer used as the light confining layer is deposited according to vacuum deposition by resistance heating or electron-beam heating, sputtering, ion plating, CVD (chemical vapor deposition) or the like. However, a high cost of vacuum deposition apparatuses, a high manufacturing cost of target materials, inferior efficiency of utilization of materials, and the like result in a very high manufacturing cost of photovoltaic devices using these techniques, and cause large problems for industrial application of solar cells.

As a method for solving these problems, a technique for manufacturing zinc oxide according to liquid deposition ("Formation of a ZnO film according to aqueous electrolysis", Extended Abstracts (the $65^{th}$ Autumn Meeting, 1995) of the Japan Society of Applied Physics) has been reported.

In Japanese Patent Application Laid-Open (Kokai) No. 10-195693 (1998) (U.S. Pat. No. 5,804,466), a method for forming a zinc-oxide layer according to electrolytic deposition (identical to electroplating, hereinafter abbreviated sometimes as "ED") has been proposed. In this publication, a method for forming a zinc-oxide layer on a conductive substrate by immersing a conductive substrate and an electrode in an aqueous solution containing nitrate ions, zinc ions and carbohydrate, and applying a voltage between the conductive substrate and the electrode.

In Japanese Patent Application Laid-Open (Kokai) No. 10-140373 (1998) (U.S. Pat. No. 5,804,466), a method for forming a uniform zinc-oxide layer having an excellent substrate adhesion property according to ED has been proposed. More specifically, the method has a process of forming a first zinc-oxide layer on a substrate according to sputtering, and a process of forming a second zinc-oxide layer on the first zinc-oxide layer by immersing the substrate in an aqueous solution containing at least nitride ions, zinc ion and carbohydrate, and applying a voltage between the substrate and an electrode immersed on the solution.

According to these methods, since a vacuum deposition apparatus and a target that are expensive are unnecessary, it is possible to greatly reduce the production cost of zinc oxide. Since deposition can also be performed on a large substrate, these methods are promising for manufacturing a large photovoltaic device, such as a solar cell.

However, such methods of electrochemically depositing zinc oxide have problems to be solved.

That is, when forming a zinc-oxide layer according to ED, if a conductive substrate is used, a zinc-oxide layer is more or less deposited also on a non-film-forming surface (the back) as well on a film-forming surface of the substrate. The zinc-oxide layer deposited on the back of the substrate (hereinafter termed a "back film") sometimes has a property different from the property of the zinc-oxide layer deposited on the surface of the substrate depending on deposition conditions (mainly a manner of application of an electric field). More specifically, the back film sometimes becomes a low-density and fragile film having different surface roughness and mechanical strength. If such a back surface is more or less present, the following problems will arise when forming, for example, a semiconductor device, such as a photovoltaic device (solar cell) or the like.

(1) When using a substrate having a zinc-oxide layer formed thereon according to ED for manufacturing a photovoltaic device, photoelectric conversion characteristics may be degraded due to degassing in a vacuum apparatus. Particularly, since the back film tends to have a low density and a large surface area, there is a large possibility of introducing absorbed gases, such as oxygen, nitrogen, water and the like, into the vacuum apparatus.

(2) When conveying the substrate within the vacuum apparatus, the back film may peel to produce dust, resulting in contamination of the inside of the vacuum apparatus, and degradation of characteristics by being mixed in the semiconductor layer or the like.

(3) When a roll-to-roll configuration is used, the back film is also wound during a winding process, in which the back surface may peel to be mixed between substrates as foreign matter. In this case, the foreign matter may contact the zinc-oxide layer deposited on the surface, thereby causing a possibility of producing damage.

(4) Deviation in winding and problems in conveyance may occur due to variations in the coefficient of friction caused by the presence of the back film.

(5) When performing soldering, bonding by an adhesive, or the like at the back surface as a post-process after forming the zinc-oxide layer, the film of the back surface may cause insufficient soldering, degradation of the adhesive property, and the like.

In other technical fields, when intending to perform plating only on one surface of a long conductive substrate, the presence of the back film may cause various problems, such as bad influence on a post-process, degradation of appearance, and the like. Accordingly, a method for preventing formation of the back film as much as possible, or removing the formed back film is requested.

In order to remove the back film, Japanese Patent Application Laid-Open No. 11-286799 (1999) discloses a method of etching a zinc-oxide layer deposited on the back of a substrate according to electrolysis using a back-film-adhesion preventing electrode. This method can greatly reduce formation of the back film. However, it is difficult to remove only a zinc-oxide layer deposited on the back of a substrate without badly influencing a zinc-oxide layer formed on the surface. Furthermore, when using a metal film that is reactive with an oxidizing liquid, such as silver or the like, between the substrate and zinc oxide, there is the possibility that electrochemical reaction is also exerted to the metal film by an electric field for etching, and problems, such as discoloration, dissolution and the like, may arise in the metal film.

Japanese Patent Application Laid-Open (Kokai) No. 10-60686 (1998) (application in a second country not confirmed) discloses a technique for preventing adhesion of plating on a non-plating surface by disposing, when performing continuous plating on one surface of a metal strip, an insulator, operating as a blocking member, between an edge portion of the strip and an anode. A similar blocking technique is also described in Japanese Patent Application Laid-Open (Kokai) No. 2002-155396 (2002) (application in a second country not confirmed). However, these techniques have the problem that it is very difficult to perform optimum design of an apparatus for effectively preventing adhesion of plating on a non-plating surface as well as performing uniform plating on a plating surface. Furthermore, since such optimum design may differ depending on plating conditions, it is impossible to design an apparatus capable of flexibly dealing with changes in plating conditions.

Japanese Patent Application Laid-Open (Kokai) No. 10-259496 (1998) (U.S. Pat. No. 6,077,411) proposes a technique for preventing deposition of a zinc-oxide layer on the back of a substrate when forming a zinc-oxide layer according to ED. More specifically, deposition of an unnecessary zinc-oxide layer on the back of a long substrate immersed in an aqueous solution containing nitrate ions and zinc ions by providing a rotating belt for conveying the substrate while covering one surface of the substrate.

According to this method, it is possible to effectively suppress deposition of the back film. However, since it is necessary to provide a configuration of conveying a member for covering the back of a substrate, the configuration of the apparatus is complicated, and the cost of the apparatus will increase.

SUMMARY OF THE INVENTION

It is an object of the present invention to provide a plating apparatus and method for suppressing deposition of an unnecessary film on a conductive substrate with a low cost.

According to one aspect of the present invention, a plating apparatus includes a plating vessel for holding a plating bath containing at least metal ions, a conveying device for conveying a long conductive substrate and immersing the long conductive substrate in the plating bath, a facing electrode disposed in the plating bath so as to face one surface of the conductive substrate, voltage application means for performing plating on the one surface of the conductive substrate by applying a voltage between the conductive substrate and the facing electrode, and film-deposition suppression means fixedly disposed in the plating vessel so that at least a portion of the film-deposition suppression means is close to shorter-direction edges of the conductive substrate, at least the portion of the film-deposition suppression means close to the shorter-direction edges of the conductive substrate being conductive. By holding the conductive portion of the film-deposition suppression means and the conductive substrate at substantially the same potential, film deposition on the other surface of the conductive substrate is suppressed.

According to another aspect of the present invention, a plating apparatus includes a plating vessel for holding a plating bath containing at least metal ions, a conveying device for conveying a long conductive substrate and immersing the long conductive substrate in the plating bath, a facing electrode disposed in the plating bath so as to face one surface of the conductive substrate, voltage application means for performing plating on the one surface of the conductive substrate by applying a voltage between the conductive substrate and the facing electrode, and a member fixedly disposed in the plating vessel so that at least a portion of the member contacts the surface of the conductive substrate (a surface of the conductive substrate opposite to the one surface, in other words, a surface not for plating), at least the portion contacting the other surface of the conductive substrate being conductive.

According to still another aspect of the present invention, in a plating method of conveying a long conductive substrate while causing it to pass through a plating bath held in a plating vessel, and performing electroplating on one surface of the conductive substrate in the plating bath, film deposition on the other surface of the conductive substrate is suppressed by fixedly disposing film-deposition suppression means set to substantially the same potential as the conductive substrate in the plating vessel so as to be close to shorter-direction edges of the conductive substrate on the other surface.

In the present invention, a description of "fixedly disposing in the plating vessel" includes not only a case of being directly fixed to the plating vessel, but also a case in which a relative position with the plating vessel does not change by being fixed to a member other than the plating vessel, the ground or the like.

The foregoing and other objects, advantages and features of the present invention will become more apparent from the following description of the preferred embodiments taken in conjunction with the accompanying drawings.

DESCRIPTION OF THE PREFERRED EMBODIMENTS

A preferred embodiment of the present invention will now be described with reference to the drawings.

Figure 1:
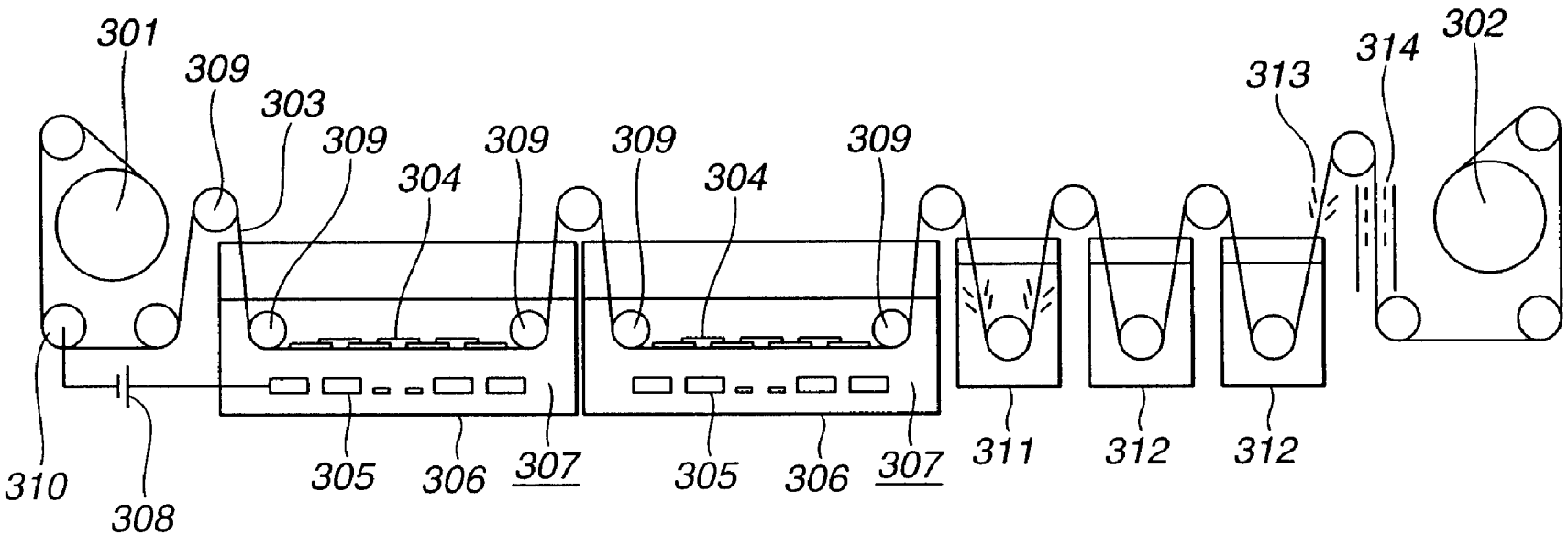
FIG. 1 is a schematic diagram illustrating a plating apparatus according to a preferred embodiment of the present invention.

As shown in FIG. 1, a plating apparatus according to the preferred embodiment includes a plating bath 307 containing at least metal ions, a plating vessel 306 for holding the plating bath 307, conveying devices 301, 302 and 309 for conveying a long conductive substrate 303 and immersing it in the plating bath 307, facing electrodes 305 disposed so as to face one surface of the conductive substrate 303 (the lower surface in the case of FIG. 1), voltage application means 308 for performing plating on the one surface of the conductive substrate 303 by applying a voltage between the conductive substrate 303 and the facing electrodes 305, and a feeding member 310 for performing electric connection between the conductive substrate 303 and the voltage application means 308. The long conductive substrate 303 is in most cases cut into short peaces after a plating process. In this specification, a substrate before being cut is discriminated from a substrate after being cut as a "long substrate". The conveying devices are classified as a feeding roller 301, a winding roller 302 and conveying rollers 309. Although in this embodiment, the feeding member 310 also operates as a conveying roller, a feeding member may be provided separately from a conveying roller, and the feeding member 310 and the voltage application means 308 may be connected via the ground.

Figure 2A:
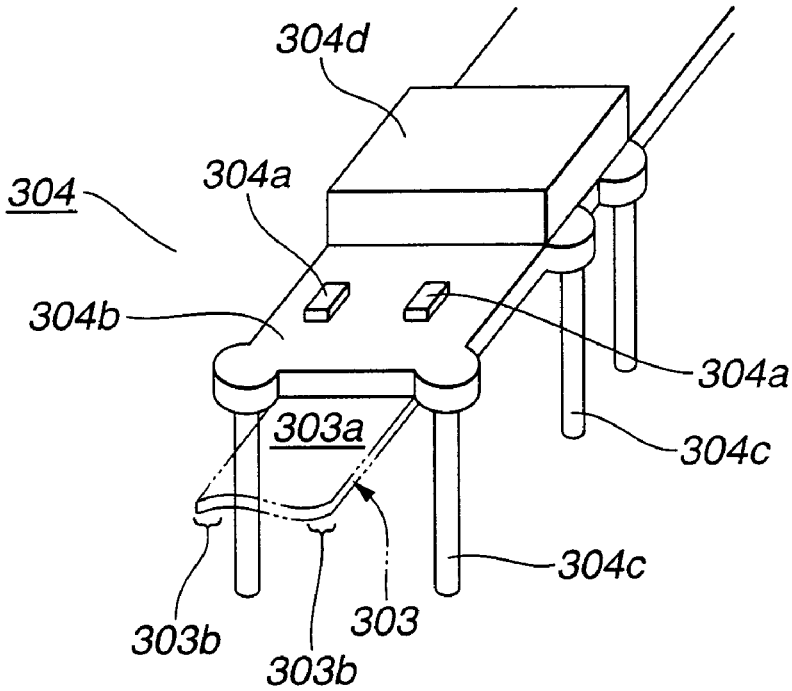
FIGS. 2A and 2B are a perspective view and a side view, respectively, illustrating an external appearance of film-deposition suppression means.

The plating apparatus of the embodiment includes film-deposition suppression means 304 disposed at the other surface of the long substrate 303 (the upper surface in the case of FIG. 1). As shown in FIG. 2A in detail, this film-deposition suppression means 304 is fixedly disposed in the plating vessel 306 so that at least a portion of the film-deposition suppression means 304 is closed to shorter-direction edges of the long substrate 303 at the other surface (represented by reference numeral 303*a*), and at least the portion close to the shorter-direction edges of the long substrate 303 (represented by reference numeral 303*b*) is conductive. By holding the conductive portion of the film-deposition suppression means 304 and the long substrate 303 at substantially the same potential, film deposition on the other surface 303*a* of the long substrate 303 is suppressed.

As shown in FIG. 2A, in order to suppress film deposition on the other surface 303*a* of the long substrate 303, the film-deposition suppression means 304 may be arranged along the entirety of the other surface 303*a* of the long substrate 303. In this case, only a portion close to the shorter-direction edges 303*b* may be conductive, or the entirety of the portion close to the other surface 303*b* of the long substrate 303 may be conductive. From the viewpoint of easily manufacturing the apparatus of the invention, it is preferable that the entirety of a portion disposed along the entire other surface 303*a* of the long substrate 303 (represented by reference numerals 304*b* and 304*d*, to be described later) of the film-deposition suppression means 304 is conductive. Instead of horizontally disposing the film-deposition suppression means 304 along the other surface 303*a* of the long substrate 303, the film-deposition suppression means 304 may be vertically (in the form of a wall) disposed so as to extend upward from the both ends 303*b*. When constituting such a vertical wall with a conductive member, film deposition on the other surface 303*a* of the long substrate 303 can be suppressed.

In order to set the conductive portion of the film-deposition suppression means 304 and the long substrate 303 to substantially the same potential, the conveying devices 301, 302 and 309 may convey the long substrate 303 so as to contact the conductive portion. In this case, magnets (represented by reference numeral 304*a* in FIGS. 2A and 2B) may be disposed On the film-deposition suppression means 304, so that the long substrate 303 is attracted by the magnets 304*a* to be brought in contact with the film-deposition suppression means 304. Although in FIGS. 2A and 2B, the magnets 304*a* are provided at upper portions, the magnets 304 may be embedded, or the film-deposition suppression means 304 itself may be made of a magnet. The conductive portion of the film-deposition suppression means 304 and the long substrate 303 may not contact each other, may be connected to a power supply, or may be grounded.

The conductive portion of the film-deposition suppression means 304 and the long substrate 303 are set to substantially the same potential, in order to provide the role of an electric shield for preventing adhesion of the back film to the conductive portion. Even if the two members are not set to the completely same potential, a certain degree of effect can be obtained. In order to easily realize "substantially the same potential", it is preferable to contact the conductive portion to the long substrate 303. Furthermore, if a configuration is adopted in which the film-deposition suppression means 304 is extended outside of the shorter-direction edges of the long substrate 303 (in other words, if the width of the film-deposition suppression means 304 is made larger than the width of the long substrate 303 in the shorter direction, to extend from the long substrate 303), the effects of preventing concentration of electrolysis toward the shorter-direction edges of the long substrate 303, and preventing abnormal film formation at the edges can be obtained. The width of extension is preferably about 5–50 mm per edge.

The film-deposition suppression means 304 may have foot members 304*c* for supporting the conductive portion. Furthermore, the film-deposition suppression means 304 may further have first members 304*b* disposed close to the shorter-direction edges 303*b* (more precisely, the shorter-direction edges 303*b* at the other surface of the long substrate 303), and the first members 304*b* may be supported by the foot members 304*c*. A plurality of the first members 304 may be fixedly disposed along the longitudinal direction of the long substrate 303 in a state of separating from each other. In this case, a second member 304*d* may be disposed so as to block the interval between the adjacent first members 304*b*. At least a portion close to the shorter-direction edges 303*b* of the long substrate 303 of each of the first members 304*b* and the second members 304*d* may be conductive. The second member 304*d* may be disposed so as to contact the long substrate 303. When the film-deposition suppression means 304 is divided into the plurality of first members 304*b*, as described above, instead of comprising a long member, the smoothness of the first members 304*b* are improved, and contact of the first members 304*b* with the long substrate 303 can be easily realized. Furthermore, since the film-deposition suppression means 304 are divided into the plurality of first members 304*b*, for example, the first member 304*b* can be easily exchanged and the film-deposition suppression means 304 can be easily maintained. If it is designed such that the foot members 304*c* are fitted and fixed to the first member 304*b*, the first member 304*b* can be easily detached. It is preferable to have a configuration in which the second member 304*d* is fitted between the adjacent first members 304*b*. According to this configuration, the second member 304*d* can be easily detached. Hence, even if maintenance, such as exchange or the like, of the facing electrode 305 becomes necessary, an operation can be performed utilizing the interval between the adjacent first members 304*b*, so that maintenance of the facing electrode 305 becomes easy. It is preferable from the viewpoint of handling that the first member 304*b* is a flat conductive plate having a thickness of 0.5–10 mm, and a size of B5-A2 format. The second member 304*d* is preferably provided by forming a projection by fixing a conductive flat plate having a size and a thickness corresponding to the interval between the adjacent first members 304*b* on a conductive flat plate having a thickness of 0.5–10 mm, and a length in a direction corresponding to the shorter direction of the long substrate 303 equal to the length of the first member 304*b*, and a length in the longer direction of the long substrate 303 equal to or less than the length of the first member 304*b* according to welding or the like. The sizes of the first member 304*b* and the second member 304*d* can be determined in consideration of the shorter-direction width of the long substrate 303. Positioning of the first member 304 may be performed using the foot members 304*c*, and positioning of the second member 304*d* may be performed using the adjacent first members 304*b*. Instead of using the foot members 304*c*, supporting members fixed to a side wall or the outside of the plating vessel 306 may be used.

Figure 2B:
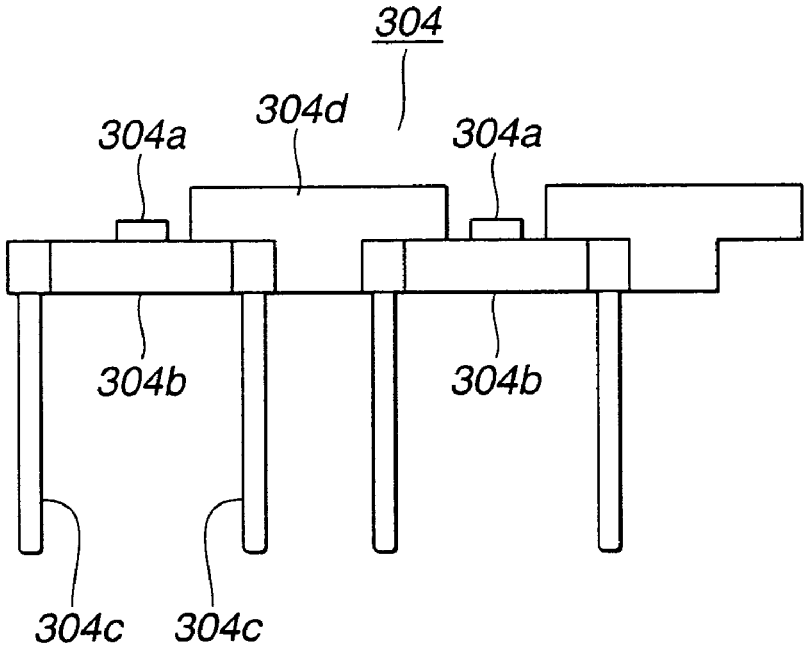

As described above, the film-deposition suppression means 304 may be disposed so as to extend outside of the shorter-direction edge of the long substrate 303. That is, the shorter-direction size (the size in a direction orthogonal to the conveying direction of the long substrate 303) of the film-deposition suppression means 304 may be set to a value larger than the shorter-direction size of the long substrate 303. The plating apparatus of the embodiment includes the plating vessel 306 for holding the plating bath 307 containing at least metal ions, the conveying devices 301 and 302 for conveying the long substrate 303 and immersing it in the plating bath 307, the facing electrodes 305 disposed in the plating bath 307 so as to face one surface of the long substrate 303, and the voltage application means 308 for performing plating on the one surface of the long substrate 303 by applying a voltage between the long substrate 303 and the facing electrodes 305. The plating apparatus also includes the member 304 fixedly disposed in the plating vessel 306 so that at least a portion of the member 304 contacts the other surface 303*a* of the long substrate 303, at least the portion contacting the other surface 303*a* of the long substrate 303 of which is conductive. The member 304 has the magnet 304*a* for maintaining contact with the long substrate 303. The member 304 has the plurality of first members 304*b* and the plurality of second members 304*d* in the longitudinal direction of the long substrate 303. The plurality of first members 304*b* are arranged with an interval, the plurality of second members 304*b* are fixed by supporting members (foot members). The second member 304*d* is disposed on upper surfaces of two adjacent first members 304*b*. The surface of the first member 304*b* facing the long substrate 303 is substantially flat. As shown in FIGS. 2A and 2B in detail, the second member 304*d* has a projection for filling the interval between the adjacent first members 304*b*, so that the surface of the projection facing the long substrate 303 and the surface of the first members 304*b* facing the long substrate 303 are disposed on substantially the same plane.

In this embodiment, the feeding means 310 and the long substrate 303 may be electrically connected, and a voltage may be applied between the facing electrode 305 and the feeding means 310 by the voltage application means 308.

In the plating method of the first embodiment, the long substrate 303 is conveyed so as to pass through the plating bath 307 held in the plating vessel 306, and electroplating is performed on one surface of the long substrate 303 in the plating bath 307. By fixedly disposing the film-deposition suppression means 304 in the plating vessel 306 so as to be close to the shorter-direction edge 303*b* at the other surface 303*a* of the long substrate 303, and maintaining the film-deposition suppression means 304 to a potential substantially the same potential as the long substrate 303, film deposition on the other surface 303*a* of the long substrate 303 is suppressed.

In this case, by contacting the film-deposition suppression means 304 to the long substrate 303, the two members may be set to substantially the same potential. The film-deposition suppression means 304 may be brought in contact with the long substrate 303 by a magnetic force. An apparatus having the above-described features may be used.

According to the above-described embodiment, film deposition on the other surface of the long substrate 303 can be suppressed. Accordingly, even when the long substrate 303 must be placed in a vacuum apparatus after a plating process, various problems caused by degassing can be mitigated. Furthermore, the problem of peeling of a film in the vacuum apparatus can be mitigated. In addition, the problem of mixture of a peeled film as foreign matter can be suppressed. In a case of using a roll-to-roll conveying method, also, the possibilities of generating deviation in winding and problems in conveyance due to variations in the coefficient of friction caused by film deposition can be reduced. Furthermore, even when performing soldering, bonding by an adhesive, or the like on a substrate after plating, a sufficient bonding strength can be secured. In addition, a failure in external appearance of the back surface can be prevented.

(Plating Apparatus and Method of a Zinc-oxide Layer)

A description will now be provided of an apparatus and method for plating a zinc-oxide layer, as an example of the above-described plating apparatus and method.

In FIG. 1, two zinc-oxide-layer plating vessels 306 are disposed. The apparatus also includes a shower vessel 311, a rinsing vessel 312, an air knife 313 for drying, and a heater 314 for drying. The conveying device includes the feeding roller 301, the winding roller 302, the conveying roller 309, and roller driving means (not shown). After immersing the long substrate 303 fed from the feeding roller 301 in the plating bath 307, the long substrate 303 may be wound around the winding roller 302.

When forming a zinc-oxide layer 103 by this apparatus, a zinc-oxide layer may be formed in advance on the surface of the long substrate 303 (refer to Japanese Patent Application Laid-Open (Kokai) No. 10-140373 (1998)). It is thereby possible to improve adhesiveness of an electrodeposited zinc-oxide layer with respect to the long substrate 303, and prevent elution of the substrate material.

A plating bath containing at least zinc ions is used as the zinc-oxide plating bath 307. The concentration of zinc ions is preferably 0.002–3.0 mol/l, more preferably 0.01–1.5 mol/l, and most preferably 0.05–0.7 mol/l. The plating bath 307 preferably contains nitrate ions, zinc ions, and saccharose or dextrin. The concentration of nitrate ions in this case is preferably 0.004–6.0 mol/l, more preferably 0.01–1.5 mol/l, and most preferably 0.1–1.4 mol/l. The concentration of saccharose is preferably 1–500 g/l, and more preferably 3–100 g/l. The concentration of dextrin is preferably 0.01–10 g/l, and more preferably 0.025–1 g/l. Thus, it is possible to efficiently form a zinc-oxide layer having a texture structure suitable as a light confining layer.

The plating bath 307 preferably contains a compound in which a 0.5–500 μmol/l of a compound obtained by combining carboxyil radical (—COOH, —COO, or —$COO^-$) with each pair of adjacent carbon atoms having an $SP^2$ hybrid orbit (C═C or adjacent carbon atoms in an aromatic ring). It is thereby possible to increase the size of projections and recesses on the surface of the zinc-oxide layer. A phthalic acid derivative, such as phthalic acid, maleic acid, potassium hydrogen phthalate or the like, may be specifically used as such a compound (refer to Japanese Patent Application Laid-Open No. 2002-167695 (2002) (U.S. AA 2002063065)).

The conductivity of the zinc-oxide plating bath 307 may, for example, be at least 10 mS/cm and equal to or less than 100 mS/cm. In consideration of reactivity, the conductivity is more preferably at least 50 mS/cm. When the conductivity is high, the reactivity of the plating bath 307 increases. As a result, it is difficult to control migrated deposition on the back of the substrate at edges of the substrate. Furthermore, as described above, abnormal growth of a needle-like, spherical or dendritic structure exceeding a micron-order size tends to occur in a deposited film on the surface of the long substrate 303. Accordingly, the upper limit of the conductivity is preferably 100 mS/cm.

A zinc plate may be used for the facing electrode 305, and a constant-current power supply may be used as the voltage application means 308.

The density of current (absolute value) between the long substrate 303 and the facing electrode 305 may be 0.1–100 $mA/cm^2$. However, as in the case of conductivity, in consideration of reactivity and the shape of the film formed on the surface of the long substrate 303, the current density is more preferably 1–30 $mA/cm^2$, and most preferably 3–15 $mA/cm^2$. The facing electrode 305 is preferably divided into a plurality of portions as shown in FIG. 1 (than in the form of a single long electrode), from the viewpoint of handling, maintenance and the like.

The temperature of the plating bath 307 may be maintained at 50° C.–100° C. by disposing a heater and a thermometer (not shown) in the zinc-oxide plating vessel 306, so that a uniform zinc-oxide layer having less abnormal growth can be efficiently formed. The plating bath 307 may be subjected to circulation using a circulation pump (not shown), a magnetic stirrer or the like.

Figure 3:
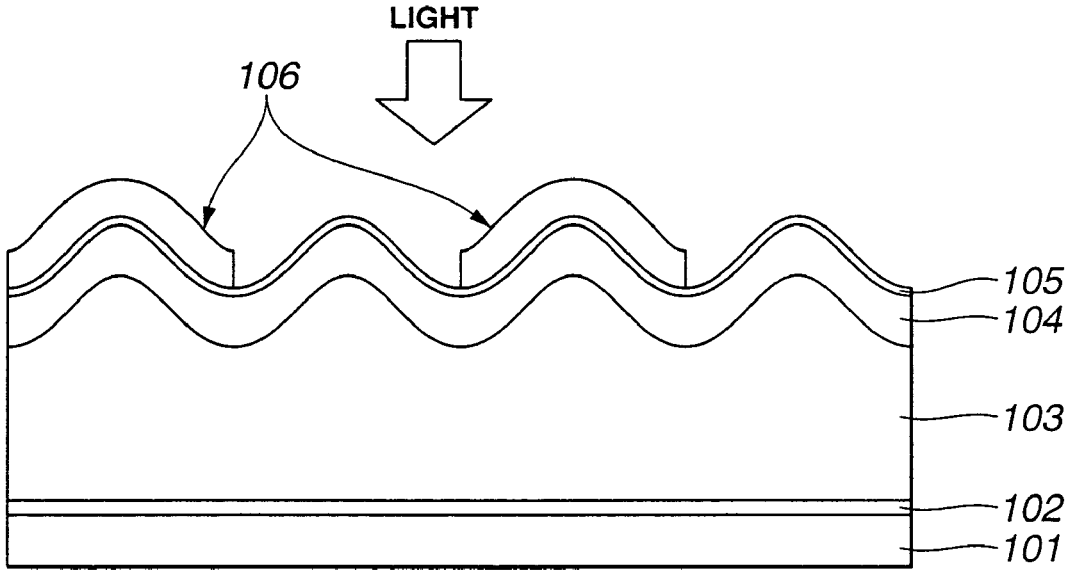
FIG. 3 is a schematic cross-sectional view illustrating a photovoltaic device that can be manufactured by a manufacturing apparatus according to the present invention.

A photovoltaic device as that shown in FIG. 3 may be manufactured using the above-described plating apparatus and method. The photovoltaic device will now be described.

FIG. 3 is a schematic cross-sectional view illustrating a photovoltaic device that can be manufactured by a manufacturing apparatus according to the invention. In FIG. 3, there are shown a supporting member 101, a metal layer (reflecting layer) 102, a zinc-oxide layer 103, a semiconductor layer 104, a transparent conductive layer 105, and a current collection electrode 106. In order to manufacture such a photovoltaic device, the supporting member 101 has a long shape, and the metal layer 102 is formed on the surface of the supporting member 101. Then, the zinc-oxide layer 103 is formed using the plating apparatus shown in FIG. 1, and then the supporting member 101 is cut. An integrated substance of the long supporting member 101 and the metal layer 102 corresponds to the above-described long substrate 303. In the photovoltaic device in which light is incident from the direction shown in FIG. 3, the metal layer 102, the zinc-oxide layer 103, the semiconductor layer 104, the transparent conductive layer 105 and the current collection electrode 106 are laminated on the supporting member 101 in this sequence. In a photovoltaic device in which light is incident from below, the current collection electrode 106, the transparent conductive layer 105, the semiconductor layer 104, the zinc-oxide layer 103 and the metal layer 102 may be laminated on the supporting member 101 in this sequence, by inverting the order of lamination from the above-described case.

Next, a description will be provided of the elements of the above-described photovoltaic device, and a method for manufacturing the photovoltaic device.

(Supporting Member)

A metal substrate made of stainless steel or the like, a resin substrate, a glass substrate, a ceramic substrate or the like is used as the supporting member 101. Fine projections and recesses may be present on the surface. When the incident direction of light is opposite to the direction indicated by a block arrow shown in FIG. 3, it is necessary to use a transparent substrate as the supporting member 101.

(Metal Layer)

The metal layer 102 has the functions of an electrode and a reflecting layer for again utilizing light reaching the supporting member 101 by reflecting the light. The metal layer 102 may be made of gold, silver, copper, aluminum, or a compound of some of these elements, and may be formed according to vacuum deposition, sputtering, electrolytic deposition, printing or the like.

By providing projections and recesses on the surface of the metal layer 102, it is possible to extend the optical length of reflected light within the semiconductor layer 104, and increase short-circuit current.

When the supporting member 101 is conductive, the metal layer 102 may not be formed. In this case, the long supporting member 101 before being cut corresponds to the above-described long substrate 303. From the viewpoint of controlling the shape of projections and recesses on the surface of the supporting member 101, the metal layer 102 is preferably provided even if the supporting member 101 is conductive.

(Zinc Oxide Layer)

The zinc-oxide layer (transparent layer) 103 has the function of extending the optical length of light within the semiconductor layer 104 by increasing irregular reflection of incident light and reflected light. In order to provide such an effect, a hexagonal polycrystalline zinc-oxide layer is preferable. The zinc-oxide layer 103 also has the function of preventing diffusion or migration of atoms and ions in the metal layer 102 into the semiconductor layer 104 to shunt the photovoltaic device. By causing the zinc-oxide layer 10 to have an appropriate resistance value, short-circuiting due to a defect, such as a pinhole or the like, in the semiconductor layer 104 can be prevented. The zinc-oxide layer 103 preferably has projections and recesses on its surface as the metal layer 102.

(Semiconductor Layer)

Amorphous or microcrystalline Si, C or Ge, or a compound of some of these elements is suitably used as the material for the semiconductor layer 104. It is desirable that the semiconductor layer 104 also contains hydrogen and/or halogen atoms. The desirable percentage content of the atoms is 0.1–40 atomic %. The semiconductor layer 104 may also contain impurities, such as oxygen, nitrogen or the like. The amount of impurities is desirably equal to or less than $5\times10^{19}$ mol/cm$^3$. A group-III element and a group-V element is desirably contained in order to make the semiconductor layer 104 a p-type semiconductor and an n-type semiconductor, respectively.

When the semiconductor layer 104 comprises a stacked cell including a plurality of pin junctions, it is desirable that the i-type semiconductor layer of the pin junction close to the light incident side has a wide band gap, and the band gap is narrowed toward a remote pin junction. Within the i-type layer, it is desirable that the minimum value of the band gap is present at a portion closer to the p-type layer than the center of the thickness. Preferred examples are a double cell in which a pin junction having an amorphous i-type layer and a pin junction having a microcrystalline i-type layer are laminated from the light incident side, and a triple cell in which a pin junction having an amorphous i-type layer, a pin junction having a microcrystalline i-type layer, and pin junction having a microcrystalline i-type layer are laminated from the light incident side.

A crystalline semiconductor having small light absorption or a semiconductor having a wide band gap is suitable for a doped layer (a p-type layer or an n-type layer) at the light incident side.

Microwave (MW) plasma CVD, VHF (very high frequency) plasma CVD, or RF (radio frequency) plasma CVD is suitable as a method for forming the semiconductor layer 104.

(Transparent Conductive Layer)

The transparent conductive layer 105 can also operate as an antireflection layer by appropriately setting its thickness. The transparent conductive layer 105 is formed by providing a film of ITO (indium tin oxide), ZnO, $In_2O_3$ or the like according to vacuum deposition, CVD, spraying, spinning-on, immersion or the like. A substance for changing the conductivity may be included in each of these compounds.

(Current Collection Electrode)

The current collection electrode 106 is provided in order to improve the current collection efficiency. The current collection electrode 106 is formed according to a method of forming a metal current collection pattern according to sputtering using a mask, a method of printing a solder paste, and a conductive paste, such as a silver paste or the like, a method of bonding metal wires using a conductive paste, or the like.

A protective layer is sometimes formed on each of both surfaces of the photovoltaic device if necessary. A reinforcing material, such as a steel sheet or the like, may also be used together with the protective layer.

EXAMPLES

The present invention will now be described in detail illustrating examples. However, the present invention is not limited to the following examples.

Example 1

In Example 1, photovoltaic devices having the structure shown in FIG. 3 were manufactured. That is, the metal layer 102, the zinc-oxide layer 103, the semiconductor layer 104, the transparent conductive layer 105 and the current collection electrode 106 were sequentially formed on the surface of the supporting member 101.

In order to manufacture photovoltaic devices having the above-described structure, a stainless-steel 430-2D plate (corresponding to the above-described long substrate) 303 having a thickness of 0.15 mm, a width of 355 mm and a length of 500 mm was prepared. A silver layer (corresponding to the above-described metal layer 102) having a thickness of 800 nm was formed on the surface of the plate 303, and a zinc-oxide layer having a thickness of 200 nm was formed thereon according to sputtering.

Thereafter, using the plating apparatus shown in FIG. 1, a new zinc-oxide layer (most of the zinc-oxide layer 103 shown in FIG. 3) having a thickness of 2.6 μm was deposited on the surface of the already formed zinc-oxide layer.

The plating apparatus used in Example 1 was configured by disposing two zinc-oxide-layer plating vessels 306, and disposing the shower vessel 311, two rinsing vessels 312, the air knife 313, the heater 314 at portions downstream from the plating vessels 306 (more precisely, downstream portions in the long-substrate conveying direction). The feeding roller 301 and the winding roller 302 were disposed at a portion upstream from and at a portion downstream from the vessels 306, 311 and 312, respectively. A plurality of conveying rollers 309 were also disposed, and the long substrate 303 was conveyed according to a roll-to-roll method.

The plating bath 307 was an aqueous solution of 0.2 mol/l of zinc nitrate, 0.1 g/l of dextrin, and 10 mg/l of potassium hydrogen phthalate, and the bath temperature was 80° C.

23 facing electrodes 305 were disposed in each of the vessels 306. Each of the electrodes 305 comprises a 4-N (99.99%) zinc plate having a width (the size in a direction orthogonal to the long-substrate conveying direction) of 400 mm, and a length (the size in the long-substrate conveying direction) of 150 mm.

A constant-current power supply 308 was disposed between the feeding member 310 and the facing electrodes 305. A voltage was applied so that the facing electrode 305 side was positive, and a current having a density of 6.7 mA/cm$^2$ (6.7 mA/cm$^2$×40 cm×15 cm≈4 A per facing electrode) was caused to flow.

As shown in FIGS. 2A and 2B, the film-deposition suppression means 304 was configured by the plurality of flat members (first members) 304*b*, each having two magnets 304*a*, the foot members 304*c*, each vertically descending from a corner of each of the flat members 304*b*, and the blocking members (second members) 304*d*, each disposed at a gap between the two adjacent flat members 304*b*, so that the flat members 304*b* and the blocking member 304*d* contact the upper surface of the long substrate 303. A stainless-steel flat plate having a thickness of 1 mm, a width of 375 mm, and a length of 500 mm was used as the first member 304*b*. A member obtained by forming a projection by welding a stainless-steel flat plate having a thickness of 1 mm, a width of 375 mm, and a length of 50 mm on a stainless-steel flat plate having a thickness of 1 mm, a width of 375 mm, and a length of 250 mm was used as the second member 304*d*. 26 pieces of the first members 304*b* and 25 pieces of the second members 304*d* were disposed per vessel 306, so that the above-described projection fills the gap between adjacent pieces of the first members 304*b*, and the first members 304*b* and the second members 304*d* extend outside of each of the lateral-direction edges of the long substrate 303 by 10 mm.

Plating was performed using the above-described apparatus. While a zinc-oxide layer was formed on the lower surface of the long substrate 303 with a substantially uniform thickness, zinc oxide was hardly deposited on the upper surface of the long substrate 303. A very small amount of back-film adhesion was observed at a portion of the shorter-direction edges 303*b* of the long substrate 303 due to fluctuation in conveyance of the long substrate 303 that inevitably occurs. As a result, degassing, and peeling of a film within the vacuum apparatus could be prevented, the problem in conveyance due to variations in the coefficient of friction could be solved, and a sufficient bonding strength could be secured even when performing soldering or the like in a post-process.

Thereafter, the semiconductor layer 104 in which three pin junctions (a pin junction having an amorphous-i-type layer, a pin junction having a microcrystalline-i-type layer, and a pin junction having a microcrystalline-i-type layer from the light incident side) are laminated was formed on the surface of the zinc-oxide layer 103 in a roll-to-roll CVD apparatus, and the ITO transparent conductive layer 104 was further deposited in a roll-to-roll sputtering apparatus. Then, the current collection electrode 106 was formed using a silver paste to obtain a photovoltaic device.

Example 2

In Example 2, a stainless-steel flat plate having a thickness of 1 mm, a width of 375 mm, and a length of 250 mm was used as the second member 304*d*, that was disposed so as to bridge adjacent first members. That is, a gap about 1 mm thick was produced between the long substrate 303 and the second members 304*d* at the interval between two adjacent first members 304*b*. Other configurations and the manufacturing method were the same as in Example 1.

In Example 2, although a slight amount of zinc oxide was deposited at the shorter-direction edges 303*b* at the upper surface side of the long substrate 303, the amount of deposition was greatly reduced in comparison with a case of not using the film-deposition suppression means 304 (in this case, a large amount of low-density fragile film adheres to the entire surface of the back). As a result, substantially the same effects as in Example 1 were obtained.

As described above, according to the preferred embodiments of the present invention, film deposition on the other surface of the conductive substrate can be suppressed. Accordingly, even when the conductive substrate must be placed in a vacuum apparatus after a plating process, various problems caused by degassing can be mitigated. Furthermore, the problem of peeling of a film in a vacuum apparatus can be mitigated. In addition, the problem of mixture of a peeled film as foreign matter can be suppressed. The problem of inferior external appearance can also be mitigated. In a case of using a roll-to-roll conveying method, also, the possibilities of generating deviation in winding and problems in conveyance due to variations in the coefficient of friction caused by film deposition can be reduced. Furthermore, even when performing soldering, bonding by an adhesive, or the like on a substrate after plating, a sufficient bonding strength can be secured.

The individual components shown in outline in the drawings are all well known in the plating apparatus and method arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A plating apparatus comprising:

a plating vessel for holding a plating bath containing at least metal ions;

a conveying device for conveying a long conductive substrate and immersing the long conductive substrate in the plating bath;

a facing electrode disposed in the plating bath so as to face one surface of the conductive substrate;

voltage application means for performing plating on the one surface of the conductive substrate by applying a voltage between the conductive substrate and said facing electrode; and a member fixedly disposed in said plating vessel so that at least a portion of said member contacts a surface of the conductive substrate opposite to the one surface, at least the portion being conductive, wherein said member comprises a plurality of first members and a plurality of second members in a longitudinal direction of the conductive substrate, each of said first members being a flat plate, wherein a plurality of said first members are disposed with a gap between adjacent ones of said members and are fixed by supporting members, and wherein each of said second members is dispersed over upper surfaces of two adjacent first members, wherein a surface of said first member facing a surface of the conductive substrate is substantially flat, wherein said second member includes a projection for filling the gap, and wherein a surface of said projection facing the conductive substrate and a surface of said first member facing the conductive member are disposed on substantially the same plane, and wherein said second member is detachable from said member.

2. A plating apparatus according to claim 1, wherein said member comprises magnets for maintaining contact with the conductive substrate.

3. A plating apparatus according to claim 1, wherein said member is extended outside of the shorter-direction edge of the conductive substrate.

4. A plating apparatus according to claim 1, wherein said member comprises foot members for supporting at least the conductive portion.

5. A plating apparatus according to claim 1, wherein said member comprises foot members for supporting said first members.

6. A plating method conducted in the plating apparatus of claim 1, including conveying a long conductive substrate while causing it to pass through a plating bath held in a plating vessel and performing electroplating on one surface of the conductive substrate in the plating bath, said method comprising the step of:

suppressing film deposition on a surface of the conductive substrate opposite to the one surface by fixedly disposing a member for film deposition suppression set to substantially the same potential as the conductive substrate in the plating vessel so as to be close to shorter-direction edges of the conductive substrate on the other surface.

7. A plating method according to claim 6, wherein the conductive substrate is conveyed while causing the member for film-deposition suppression means to contact the conductive substrate by a magnetic force.

* * * * *